US006126453A

United States Patent [19]

Gomez et al.

[11] Patent Number: 6,126,453

[45] Date of Patent: Oct. 3, 2000

[54] TRANSMISSION LINE TERMINATIONS AND JUNCTIONS

[75] Inventors: Francisco X. Gomez, Melrose Park; Henry Ryman, Orland Park; Joseph F. Mockus, North Riverside, all of Ill.

[73] Assignee: Andrew Corporation, Orland Park, Ill.

[21] Appl. No.: 09/168,650

[22] Filed: Oct. 8, 1998

[51] Int. Cl.[7] ..... H01R 12/00; H01R 11/09

[52] U.S. Cl. ..... 439/63; 439/787

[58] Field of Search ..... 439/581, 495, 439/787, 63; 333/34

[56] References Cited

U.S. PATENT DOCUMENTS

| | | | |
|---|---|---|---|
| 3,179,912 | 4/1965 | Huber et al. . | |
| 3,551,874 | 12/1970 | Volinskie . | |
| 3,553,607 | 1/1971 | Lehrfeld . | |
| 3,622,915 | 11/1971 | Davo | 333/34 |
| 3,825,861 | 7/1974 | O'Donnell . | |
| 4,169,641 | 10/1979 | Olsson | 439/493 |
| 4,335,364 | 6/1982 | Schmitz et al. . | |
| 4,431,974 | 2/1984 | Landt . | |
| 4,476,574 | 10/1984 | Struven . | |
| 4,556,265 | 12/1985 | Cunningham . | |
| 4,866,451 | 9/1989 | Chen . | |
| 4,867,704 | 9/1989 | Standke . | |
| 5,133,676 | 7/1992 | Hutchison et al. . | |
| 5,189,432 | 2/1993 | Lombardi et al. . | |
| 5,356,308 | 10/1994 | Toba et al. | 439/495 |
| 5,404,117 | 4/1995 | Walz . | |
| 5,444,775 | 8/1995 | Tobish | 379/368 |
| 5,453,750 | 9/1995 | Battista et al. . | |
| 5,469,130 | 11/1995 | Okada et al. . | |
| 5,532,659 | 7/1996 | Dodart . | |
| 5,552,753 | 9/1996 | Agarwal et al. . | |
| 5,561,405 | 10/1996 | Hoffmeister et al. . | |
| 5,570,068 | 10/1996 | Quan . | |

*Primary Examiner*—Lincoln Donovan
*Assistant Examiner*—Chandrika Prasad
*Attorney, Agent, or Firm*—Vedder, Price, Kaufman & Kammholz

[57] ABSTRACT

Termination and junction assemblies for flat strip transmission line links are shown to include a protective cover, an electrically conductive ground sleeve, a spring signal contact and a double-sided adhesive pad. A flat strip transmission line link is inserted into the ground sleeve until the contact is applied to the signal conducting strip of the link. At that time, the ground sleeve is in electrical communication with the primary signal ground carrier and the ground conducting strips of the flat strip link. The termination assemblies further include a coaxial cable receptacle that receives a coaxial cable transmission line link to establish electrical communication between its inner conductor and the contact and between its outer conductor and the ground sleeve. On the other hand, a second flat strip link is inserted into the ground sleeve of the junctions until the contact establishes a pressure contact with the signal conducting strip of the second flat strip link to establish electrical communication between the signal conducting strips of the two links and the ground strips of those links. In either case, the cover is snap-fitted to the ground sleeve and the double-sided adhesive pad is mounted to the sleeve to permit the assembly to be mounted to its installation site.

21 Claims, 4 Drawing Sheets

FIG. 1
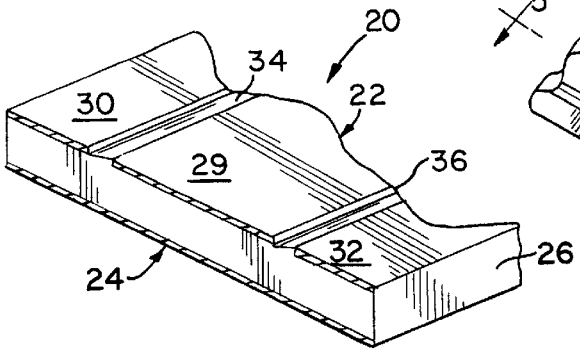
FIG. 2
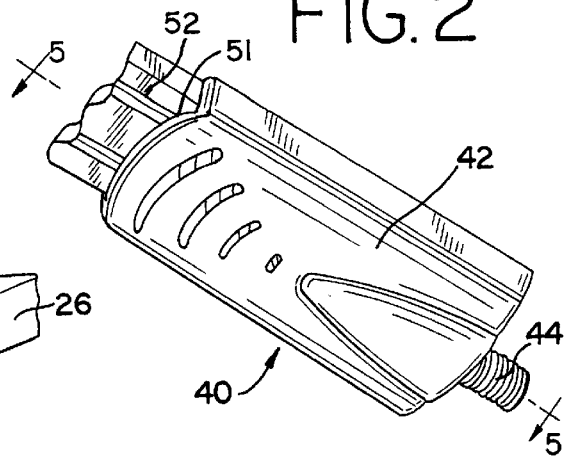
FIG. 3
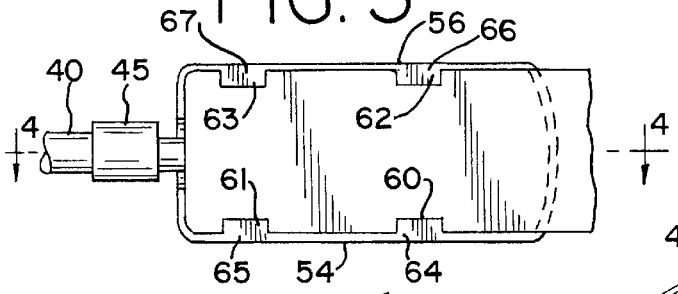
FIG. 4
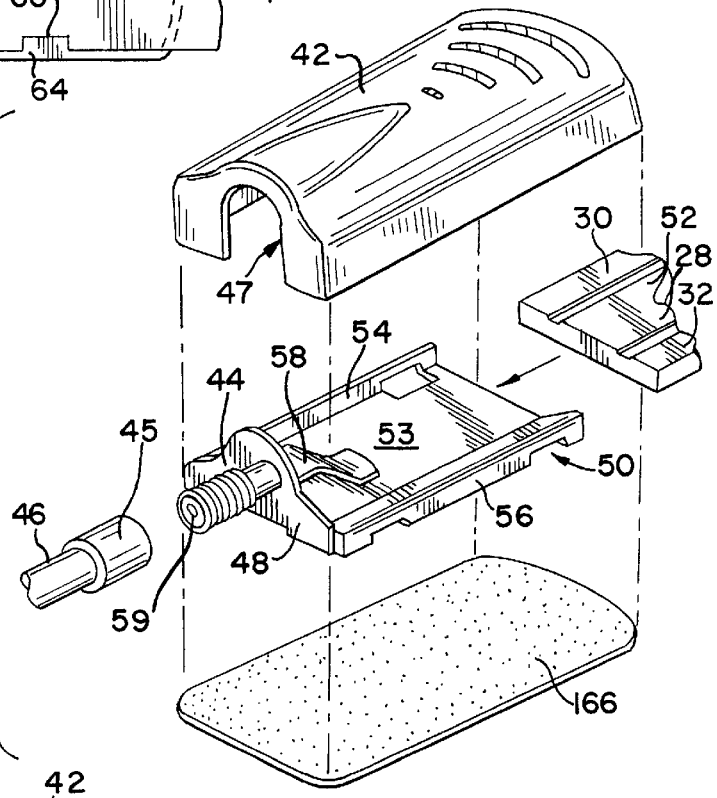
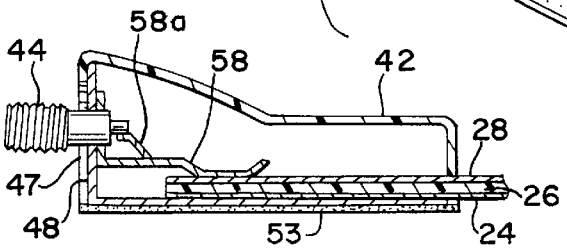
FIG. 5

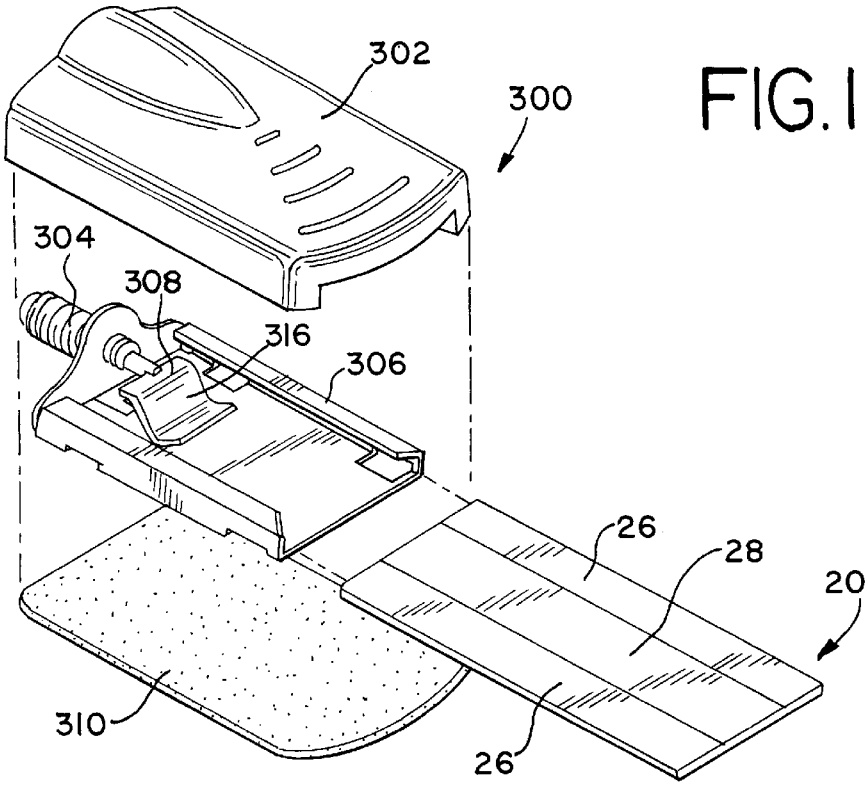
FIG.10
FIG.11
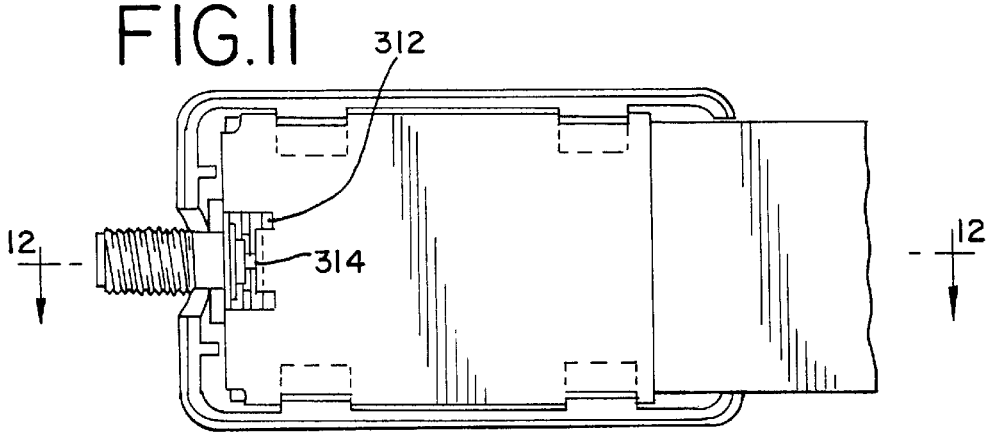
FIG.12
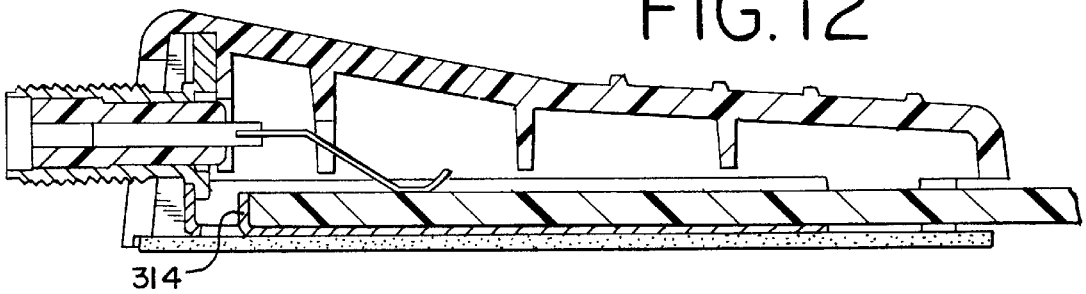

TRANSMISSION LINE TERMINATIONS AND JUNCTIONS

BACKGROUND OF THE INVENTION

The present invention relates generally to electrical and mechanical interface assemblies for transmission line links and, more particularly, to terminations and junctions for use with flat strip transmission lines.

In an effort to accommodate new products suitable for transmission of voice and data carriers for cellular and paging services, flat strip transmission lines have been developed. These transmission lines may tap into existing signal sources and transmit signals throughout buildings, including their high-rise levels and hallways, subterranean levels and hallways, and tunnels and low coverage areas.

This flat strip transmission line must often be terminated, or connected to, a coaxial cable. Such a connection is accomplished by utilizing an adapter, or connector, that accommodates the coaxial cable on one end and the flat strip transmission line on the other end. Such connectors are known in the art. U.S. Pat. No. 4,867,704, issued Sep. 19, 1989 describes a connection for coupling coaxial connectors to a strip line. This device is complex and has many parts that must be held together by screws. U.S. Pat. No. 5,453,750, issued Sep. 26, 1995 describes another connector that utilizes specially formed connecting pins. This structure is complex to assemble and the special pins may become misplaced during installation.

The present invention overcomes these deficiencies by providing a low-cost and simple termination for such transmission lines which establishes a satisfactory electrical interface connection between the flat strip transmission line link and conventional transmission line links used in communication applications, such as coaxial cable transmission line links.

Transmission lines utilizing flat strip links have further been without the benefit of junctions to provide a mechanical and electrical interface between two flat strip links. This presents a problem when the total length of a flat strip link is insufficient to cover the complete length of the transmission line. As such, there exists a need for junctions, or splices, that allow the end of one flat strip link to be in electrical communication with an adjacent flat strip link of the transmission line. Further, it would be beneficial to develop an elbow junction, or splice, that permits two flat strip links to be in electrical communication with each other when it is desired to change the direction of the transmission line path, as a result of, for example, corners along hallways in office buildings. Such junctions would preferably provide an electrical and mechanical interface between two adjacent flat strip links of a transmission line. The junctions of the present invention provide these benefits.

SUMMARY OF THE INVENTION

In accordance with the benefits of using the subject matter of the present invention during the installation of flat strip transmission lines, the termination assembly of the present invention allows a flat strip transmission line link to tap into an external signal source. The termination assembly includes a protective cover, an electrically conductive ground sleeve, a spring-loaded signal contact, a coaxial cable receptacle and an attachment adhesive pad.

A flat strip transmission line link is inserted into the ground sleeve and its end panel abuts a mechanical stop of the ground sleeve. The mechanical stop prevents the end panel of the flat strip transmission line from contacting the end wall of the ground sleeve where an electrical short may occur. As the flat strip transmission line link is inserted into the ground sleeve, the spring-loaded signal contact establishes a pressure contact with the signal conducting strip of the flat strip link. Further, the ground sleeve is in electrical communication with the primary signal ground carrier of the link, and with the secondary ground contacts of the flat strip transmission line link. A coaxial cable transmission line link is held within the coaxial cable receptacle so that its inner conductor is in electrical communication with the spring-loaded signal contact and its outer conductor is in electrical communication with the electrically conductive ground sleeve.

The protective cover is then snap-fitted to the ground sleeve. In particular, inwardly projecting tabs of the cover are mated with or received within their counterpart slots provided in the ground sleeve. An attachment pad may be mounted to the bottom panel of the ground sleeve so that the termination assembly may be adhesively mounted to its installation site.

Another embodiment of the present invention, an inline splice connector, or junction, serves as a mechanical and electrical interface for the ends of two adjacent links of a flat strip transmission line. This in-line junction includes a protective cover, a double-sided spring-biased signal contact, an electrically conductive ground sleeve and an attachment pad. The ends of the two links of the flat strip transmission line are inserted into opposite ends of the ground sleeve until the signal contact establishes a pressure contact against the signal conducting strip of each link. Each link is inserted into a particular side of the ground sleeve until its end abuts a mechanical stop located on that side. In this position, the signal and ground strips for the first link of the flat strip transmission line are in electrical communication with the signal and ground strips of the second link. The protective cover is then snap-fitted to the ground sleeve and the attachment pad allows the junction to be mounted to its installation site.

In another embodiment of the present invention, an elbow junction, or splice, is used to connect the ends of two links of an flat strip transmission line. This elbow junction may have a wide variety of angular shapes to accommodate the particular desired change of direction of the transmission line path.

It is therefore a general object of the present invention to provide a termination for transmission lines used in communication applications.

It is another object of the present invention to provide a termination for use with flat strip transmission line links.

It is another object to provide an electrical interface between flat strip transmission line links and conventional transmission line links used in communication applications, such as coaxial cable transmission line links.

It is another object of the present invention to provide junctions for electrically connecting two adjacent links of a flat strip transmission line.

It is another object of the present invention to provide a junction for providing a mechanical and electrical interface between two adjacent links of a flat strip transmission line.

It is another object of the present invention to provide an in-line junction to connect two adjacent links of a flat strip transmission line.

It is another object of the present invention to provide an in-line junction that serves as a mechanical and electrical interface between two adjacent links of a flat strip transmission line.

It is another object of the present invention to provide an elbow junction to connect two adjacent links of a flat strip transmission line and thereby accommodate any desired change in direction of the transmission line path.

It is another object of the present invention to provide an elbow junction that serves as a mechanical and electrical interface between two adjacent links of a flat strip transmission line.

It is another object of the present invention to provide an elbow junction to connect two adjacent links of a flat strip transmission line.

It is another object of the present invention to provide an elbow junction that serves as a mechanical and electrical interface between two adjacent links of a flat strip transmission line.

These and other features, objects and advantages of the present invention will become apparent from the detailed description set forth below when taken in conjunction with the drawings in which like reference numerals identify like elements throughout.

BRIEF DESCRIPTION OF THE DRAWINGS

In the course of the following detailed description, reference will be frequently made to the accompanying drawings in which:

FIG. 1 is a perspective view of the end portion of a flat strip radiax transmission line link of the type used in conjunction with the present invention;

FIG. 2 is an isometric view of a termination constructed in accordance with the principles of the present invention as viewed when installed and mounted to its installation site;

FIG. 3 is a bottom plan view of the termination shown in FIG. 2;

FIG. 4 is an exploded view of the termination shown in FIG. 2;

FIG. 5 is a sectional view of the termination shown in FIG. 2 taken along lines 5—5 thereof;

FIG. 10 is an exploded view of another embodiment of a termination constructed in accordance with the principles of the present invention;

FIG. 11 is a bottom plan view of the termination shown in FIG. 10; and

FIG. 12 is a sectional view of the termination of FIG. 11 taken along lines 12—12 thereof.

DETAILED DESCRIPTION OF THE PREFERRED EMBODIMENTS

Figure 6:
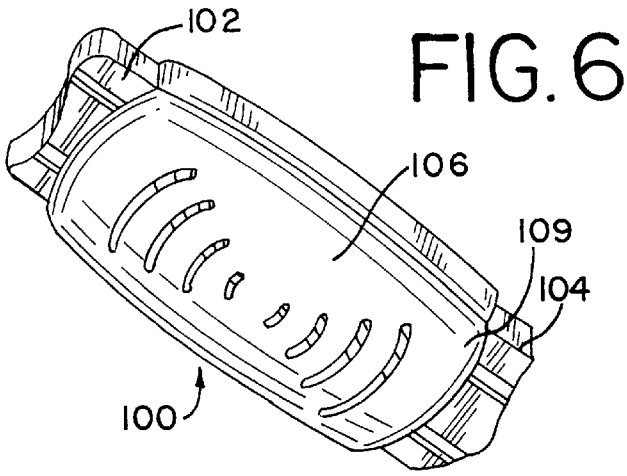
FIG. 6 is an isometric view of an in-line junction constructed in accordance with the principles of the present invention shown in an installed condition.

FIG. 1 illustrates the end portion of a link of a flat strip transmission line generally designated 20 which includes two thin, conductive copper layers 22, 24 separated by an expandable foam dielectric layer 26. Such a flat strip transmission line is sold under the trade name "Radiax" by Andrew Corporation of Orland Park, Ill. Layer 22 of the link includes three parallel conducting strips. In that regard, layer 22 includes a signal conducting strip 28 extending lengthwise along the mid-portion of the layer. Two additional conducting strips 30, 32, which serve as secondary ground contacts, extend lengthwise on opposite sides of the center positioned conducting strip 28. As shown, and as is the case with the preferred embodiment, conducting strips 30, 32 are thinner than the center conducting strip 28.

Center conducting strip 28 is preferably isolated from conducting strip 30 by a dielectric separation gap 34. Likewise, conducting strip 28 is isolated from conducting strip 32 by a dielectric separation gap 36. The bottom copper layer 24 includes a single, continuous conducting strip which serves as the primary ground signal carrier for the flat strip transmission line.

Referring now to FIG. 10, the flat strip transmission line link 20 is shown to include only conducting strip 28 on top layer 22. In that regard, the expandable foam dielectric layer 26 borders conducting strip 28 on both sides thereof. This elimination of conducting strips 30, 32 (see FIG. 1) does not materially affect operation of transmission line link 20 insofar as the present invention is concerned.

Figure 9:
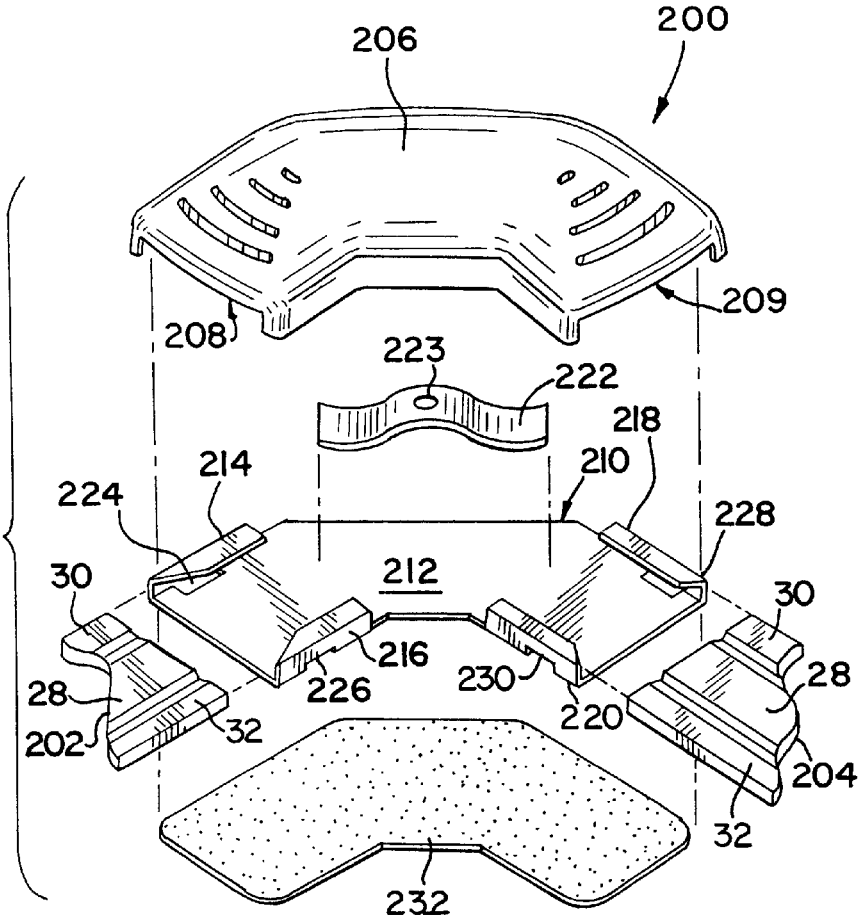
FIG. 9 is an exploded view of the elbow junction of FIG. 8.

Flat strip transmission line links, such as the one shown in FIG. 1 and the one shown in FIG. 9, provide clear benefits for in-building communication applications. Transmission lines having such links, however, require a termination for providing an electrical and mechanical interface between conventional communication transmission line links, such as coaxial cable transmission line links, and the flat strip transmission line link. In the past, no such termination was available for transmission lines utilizing flat strip links.

FIG. 2 illustrates a termination assembly 40 constructed in accordance with the principles of the present invention that provides an electrical interface between a flat strip transmission line link and another transmission line link that is preferably connected to an external signal source or transceiver (not shown). In particular, termination assembly 40 provides the electrical connection between a conventional RF coaxial cable transmission line link and a flat strip transmission line link while yielding low loss and while matching the impedance between the two links.

The termination assembly 40 preferably includes a protective cover component 42, which, beyond merely protecting the other components of the assembly from the external environment, helps to maintain the low profile and low visibility of the assembly.

The termination assembly 40 further includes a conventional coaxial cable receptacle 44 having a threaded neck portion that selectively mates with the opposing threads of an internally threaded head portion 45 of a coaxial cable transmission line link 46 (FIG. 3) connected to an external signal source or transceiver. The termination assembly 40 permits the flat strip transmission line link to tap into external signal sources for transmission of electromagnetic signals ranging from approximately 400 MHz to 2.2 GHz, while allowing usage of frequency bands therein for cellular/portable phone use and paging.

FIGS. 4 and 5 illustrate the termination assembly 40 and shows the cover 42 as including an open mouth portion 47 at one end that accommodates an end wall 48 of a ground sleeve component 50 to which receptacle 44 is mounted. At its other end, cover 42 includes an open end portion 51 (FIG. 2) that accommodates the flat strip transmission line link 52 that is inserted into the housing of the termination assembly.

In addition to end wall 48, the ground sleeve 50 of the termination assembly 40 includes a bottom wall 53 and two side grip rails 54, 56. Side grip rails 54, 56 are designed to snugly accommodate link 52 and grip conducting strips 30, 32 of that link after it is inserted into the ground sleeve 50. It will be appreciated that in this embodiment of the present invention, and in those others described herein, if a transmission line link 20 of the type shown in FIG. 9 is used, side grip rails 54, 56 will not grip conducting strips 30, 32, but rather will grip expandable foam dielectric material 16 bordering each side of conducting strip 28.

Ground sleeve 50 also preferably includes a spring-loaded signal contact 58 associated therewith that is positioned to snugly engage conducting strip 28 of the flat strip transmission line link 52 after the link 52 is inserted into the ground sleeve 50.

End wall 48 of the ground sleeve 50 is electrically connected to the outer conductor portion of coaxial cable receptacle 44. The outer conductor of the coaxial cable 46 that is connected to receptacle 44 is grounded in accordance with conventional practice. As a result, end wall 48 is also grounded and, in turn, so are its bottom wall 53 and side grip rails 54, 56. This permits the bottom layer 24 and the conducting strips 30, 32 of the flat strip transmission line link 52 to serve as a ground plane and secondary ground contacts, respectively, for the transmission line.

When link 52 is fully inserted into the ground sleeve 50 so that the spring-loaded contact 58 snugly engages the signal carrier conducting strip 28, the spring-loaded contact 58, and particularly its locating barb 58a (FIG. 5), is brought into electrical connection with the inner conductor of the coaxial cable link 46. As such, a signal connection is obtained between the inner conductor of coaxial cable link 46 and the signal carrier conducting strip 28 of the flat strip transmission line link 52 when the inner conductor of the coaxial cable link is axially inserted into the conventional bore 59 of receptacle 44. That is, when the flat strip transmission line link 52 is longitudinally inserted into ground sleeve component 50, the termination assembly 40 provides an electrical interface between the flat strip transmission line link and the coaxial cable transmission line link 46 received within coaxial cable receptacle 44.

Accordingly, the flat strip transmission line link 52 may receive signals from an external signal source connected to that coaxial cable transmission line link 46 or, alternatively, establish a communication link for a transceiver connected to the coaxial cable link.

Referring to FIG. 3, the ground sleeve 50 includes a slot 60 positioned at one end of side grip rail 54. An additional slot 61 is positioned at the opposite end of side grip rail 54. Similarly, a slot 62 is positioned at one end of side grip rail 56 so that it is generally positioned opposite of slot 60. A slot 63 is positioned at the other end of side grip rail 56 so that it is generally positioned opposite slot 61. All of these slots permit the protective housing component 42 to be snap-fitted to the ground sleeve component 50. In particular, inwardly projecting tabs 64–67 are included on the inside surface of the side walls of housing component 42 and are aligned with the slots 60–63 so that each tab 64–67 will extend through its corresponding slot 60–63 to secure the protective housing component 42 to the ground sleeve component 50.

As shown in FIG. 4, the termination assembly 40 further may include an attachment pad shown in the form of a double-sided adhesive pad 166 that permits the assembly to be mounted to its installation site. A liner (not shown) on one side of the adhesive pad 166 is removable so that the pad may be mounted to an underside surface of the bottom panel 53 of the ground sleeve component 50. When it is desired to mount the termination assembly 40 to its installation site, the protective liner (not shown) on the opposite side of adhesive pad 166 is removed to expose the pressure-sensitive adhesive impregnated on that side of the pad. As such, the termination assembly 40 may be mounted to its installation site.

FIGS. 10–12 illustrate another embodiment of a termination assembly 300 to join a flat strip transmission line link and a coaxial cable transmission line link. Termination assembly 300 includes a protective cover 302, a coaxial cable receptacle 304, an electrically conductive ground sleeve 306, a spring-loaded signal contact 308, and a double-sided adhesive pad 310. The termination assembly 300 is similar to termination assembly 40 described above.

Referring to FIG. 11, it will be understood that termination assembly 300 includes an open portion 312 cut away from the bottom wall of electrically conductive ground sleeve 306. Extending from open portion 312 is a stop member, see FIG. 12, which prevents the end of flat strip transmission line link 20 from abutting the end wall of the electrically conductive ground sleeve component 306. Another difference between termination assembly 300 and termination assembly 40 is that signal contact 308 does not include a locating barb, but rather includes an expanded contact portion 316 of about the same width as signal conducting strip 28, thereby enhancing the connection with conducting strip 28 of transmission line link 20.

FIG. 6 illustrates an in-line junction assembly 100 constructed in accordance with the principles of the present invention that provides an electrical interface between two adjacent links 102, 104 of a flat strip transmission line. The junction assembly 100 retains the end portions of links 102, 104 in place so that the signal and ground conducting strips of link 102 may be electrically connected to their corresponding signal and ground conducting strips of link 104. The junction assembly 100 includes a protective cover 106, which not only protects the components of the junction from exposure to the external environment, but also helps to maintain its low profile and low visibility.

Figure 7:
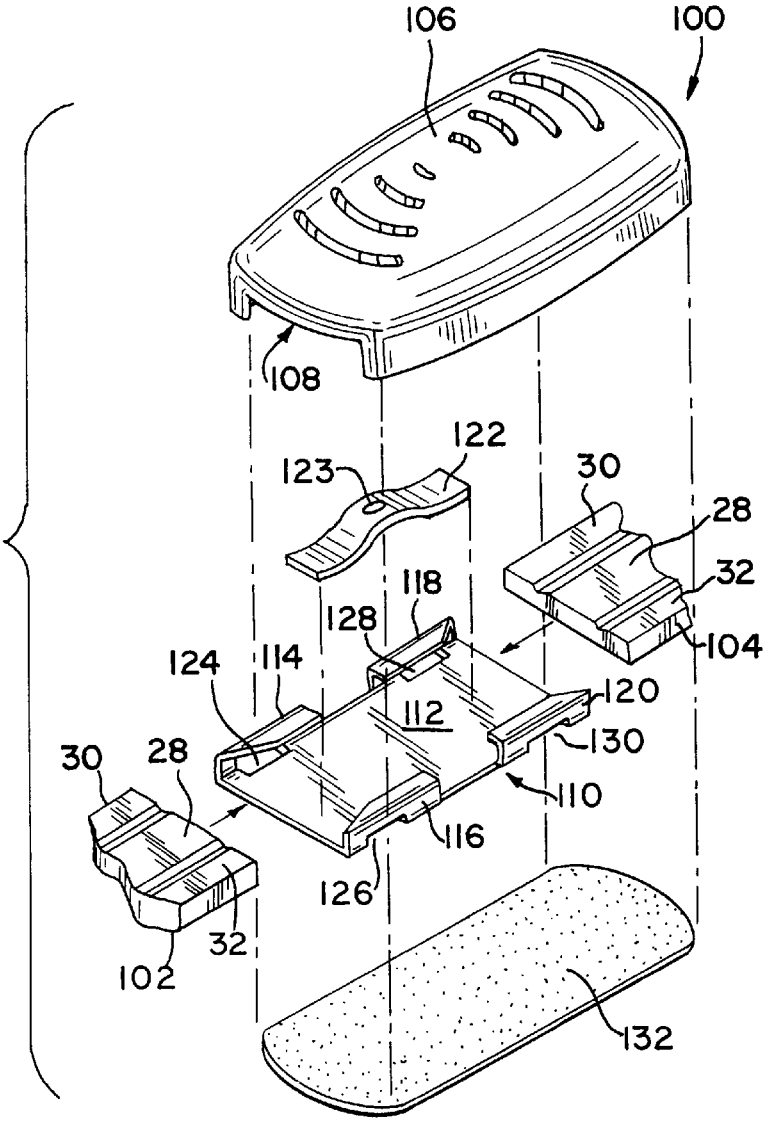
FIG. 7 is an exploded view of the in-line junction of FIG. 6.

FIG. 7 illustrates the junction assembly 100 and shows its housing component 106 as including a first end portion 108 that is designed to accommodate link 102 of the flat strip transmission line. Similarly, protective cover 106 also includes, at its opposite end, a second end portion 109 (see FIG. 6) that accommodates link 104 of the flat strip transmission line.

FIG. 7 also shows an electrically conductive ground sleeve 110 for the junction assembly 100. The ground sleeve 110 includes a bottom wall 112 and four side grip rails 114, 116, 118, 120. Side grip rails 114, 116 are designed to snugly accommodate link 102 of the flat strip transmission line and grip conducting strips 30, 32, respectively, after the link is longitudinally inserted into the ground sleeve 110. Similarly, side grip rails 118, 120 are designed to snugly accommodate link 104 of the flat strip transmission line and grip conducting strips 30, 32, respectively, after the link is longitudinally inserted into the ground sleeve 110.

As such, conducting strips 30, 32 and ground strip 24 of link 102 are in electrical communication with conducting strips 30, 32 and ground strip 24 of link 104 to enable all of those strips to be grounded.

The ground sleeve 110 also includes a double-sided spring-loaded contact 122 associated therewith that is designed to snugly engage, at one end, conducting strip 28 of link 102 and, at the other end, conducting strip 28 of link 104 after both links are inserted into the ground sleeve component. As such, strips 28 of each of links 102, 104 are brought into electrical communication with each other to enable the in-line junction assembly 100 to provide an electrical interface between the adjacent links. A bore 123 extends through double-sided spring-loaded contact 122 to permit the contact to be ultrasonically welded to protective housing 106.

Ground sleeve 110 also includes four slots 124, 126, 128, 130 positioned adjacent to side grip rails 114, 116, 118, 120, respectively. These slots permit the protective housing 106 to be snap-fitted to the ground sleeve 110. Inwardly projecting tabs (not shown) are aligned with the slots and are positioned on the inside surface of the side walls of cover 106. When cover 106 is mounted to ground sleeve 110, each tab extends through its corresponding slot to secure the protective housing to the ground sleeve in a snap-fit arrangement.

The junction assembly 100 further includes a double-sided adhesive pad 132 that permits the assembly to be mounted to its installation site. A liner on one side of the adhesive pad 132 is removed so that the pad may be mounted to an underside surface (not shown) of the bottom wall 112 of the ground sleeve component 110. When it is desired to mount the in-line junction assembly 100 to its installation site, the protective liner on the opposite side of adhesive pad 132 is removed to expose the pressure-sensitive adhesive and the inline junction assembly 100 may be mounted to its installation site.

Figure 8:
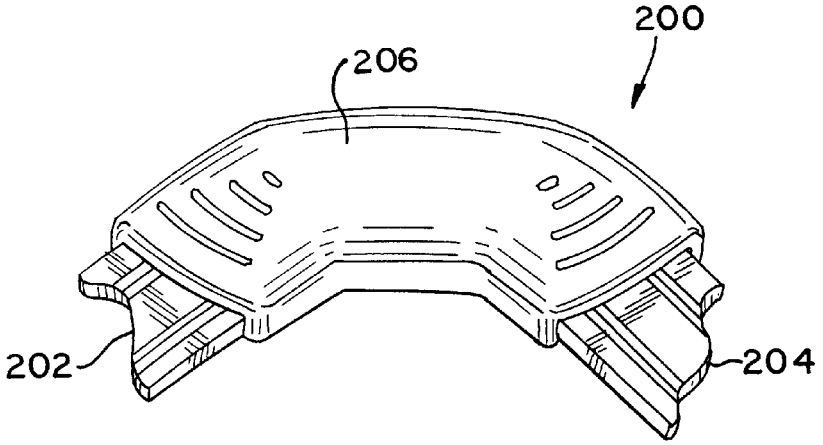
FIG. 8 is a perspective view of an elbow junction constructed in accordance with the principles of the present invention shown in an installed condition.

FIG. 8 illustrates an elbow junction assembly 200 constructed in accordance with the principles of the present invention that provides an electrical interface between two adjacent links 202, 204 of a flat strip transmission line that are angularly offset from each other. Although it is shown for purposes of illustration as being a 90° elbow junction, those skilled in the art will recognize that this type of elbow junction 200 may have a variety of angular orientations, depending on the desired change of direction in the transmission line path.

The elbow junction assembly 200 retains the end portions of links 202, 204 in place so that the conducting strips of link 202 may be electrically connected to their corresponding conducting strips of link 204. The elbow junction assembly 200 includes a protective cover 206 which protects the components of the junction from exposure to the external environment and helps to maintain its low profile and low visibility.

FIG. 9 illustrates the junction assembly 200 in detail and shows its cover 206 as including two open end portions 208, 209 that accommodate links 202, 204 of the flat strip transmission line. An electrically conductive ground sleeve 210 is provided as part of the junction assembly 200 and has a specific angular orientation matching the orientations of cover 206 and the path of links 202, 204. The ground sleeve 210 includes a bottom wall 212 and four side grip rails 214, 216, 218, 220. Side grip rails 214, 216 are designed to snugly accommodate link 202 and grip conducting strips 30, 32 of that link after it is inserted into the ground sleeve component 200. Similarly, side grip rails 218, 220 are designed to snugly accommodate link 204 and grip conducting strips 30, 32 after insertion thereof into the ground sleeve 200.

As such, conducting strips 30, 32 and the ground strip 24 of link 202 are in electrical communication with conducting strips 30, 32 and ground strip 24 of link 204 via ground sleeve 210.

The assembly 200 also includes a double-sided spring contact 222 associated therewith that is designed to snugly engage, at one end, conducting strip 28 of link 202 and, at the other end, conducting strip 28 of link 204 after both links are inserted into the ground sleeve component. As such, strips 28 of each of links 202, 204 are brought into electrical communication with each other to enable the elbow junction assembly 200 to provide an electrical interface between the adjacent links. A bore 223 may be provided in the center of the spring contact 222 to permit the contact to be attached to cover 206, such as by ultrasonic welding.

Ground sleeve 210 also includes four slots 224, 226, 228, 230 positioned adjacent to side grip rails 214, 216, 218, 220, respectively. These slots permit the cover 206 to be snap-fitted to the ground sleeve component 210. In particular, inwardly projecting tabs (not shown), each of which is associated with one of the slots, are included on the inside surface of the side walls of housing component 206. Again, it will be appreciated that this construction may be similar to that described above with reference to FIG. 3. When cover 206 is mounted to sleeve 210, each tab extends through its corresponding slot to secure the protective housing to the ground sleeve.

The junction assembly 200 further includes a double-sided adhesive pad 232 that permits the assembly to be mounted to its installation site. A liner on one side of the adhesive pad 232 is removed so that the pad may be mounted to an underside surface (not shown) of the bottom panel 212 of the ground sleeve component 210. When it is desired to mount the elbow junction assembly 200 to its installation site, the protective liner on the opposite side of adhesive pad 232 is removed to expose the pressure-sensitive adhesive impregnated on that side of the pad. As such, the elbow junction assembly 200 may be mounted to its installation site.

Although the present invention has been shown and described with reference to several preferred embodiments, those skilled in the art will recognize that changes and modifications may be made therein without departing from its true spirit and scope, which is defined by the appended claims.

What is claimed:

1. An electrical junction assembly for joining together first and second links of a radio frequency transmission line, each of the first and second links having respective ground and signal leads, the junction assembly comprising, in combination:

a conductive sleeve member for providing a conductive ground path between said ground leads of said first and second links, said sleeve having first and second opposing ends, said first end including an opening that receives therein an end of said link, said sleeve contacting said first link ground lead, said sleeve member second end having means for receiving said second link;

a cover that engages and overlies said sleeve member, the cover having a size sufficient to cover said first and second opposing ends of said sleeve member; and a spring contact disposed on an interior surface of said cover and facing said sleeve member the spring contact extending between and contacting said first and second link signal leads when said cover is engaged with said sleeve member for providing an electrical connection between said first and second signal leads.

2. The assembly as defined in claim 1, wherein said means for receiving said second link includes a receptacle having a first portion in electrical communication with said sleeve member and a second portion in electrical communication with said spring contact.

3. The assembly as defined in claim 2, wherein said receptacle comprises a coaxial cable receptacle.

4. The assembly as defined in claim 1, wherein said cover includes at least one engagement tab projecting inwardly from an inside surface of said cover, and said sleeve member includes at least one slot sized to receive said engagement tab to securely engage said cover to said sleeve member in a snap-fit arrangement.

5. The assembly as defined in claim 1, wherein said sleeve member includes a first side grip rail that retains said first link in place within said sleeve member.

6. The assembly as defined in claim 8, wherein said sleeve member includes a second side grip rail that retains said first link in place within said sleeve member.

7. The assembly as defined in claim 6, wherein said sleeve member includes a third side grip rail that retains said second link in place within said sleeve member.

8. The assembly as defined in claim 7, wherein said sleeve member comprises a fourth side grip rail that retains said second link in place within said sleeve member.

9. A connector for coupling a coaxial cable transmission line to a flat strip transmission line, the coaxial cable having distinct ground and signal leads, the flat strip line also having distinct ground and signal leads, the connector comprising:

a sleeve member formed from a conductive material in the form of a panel for receiving a length of said flat strip link therein, the sleeve member having a channel portion at one end thereof for receiving said flat strip line length therein, said sleeve member further abuttingly contacting said flat strip link ground lead, a coaxial cable receptacle at another end thereof having distinct ground and signal portions, the coaxial cable receptacle being supported by said sleeve such that said coaxial cable receptacle ground portion is in electrical communication with said sleeve and said coaxial cable receptacle signal portion is electrically isolated from said sleeve, a spring contact extending from said coaxial cable receptacle signal portion into opposition with said flat strip link signal lead such that said spring contact abuttingly contacts said flat strip link signal lead once said flat strip link is inserted into said sleeve, and, a cover that engages said sleeve and at least partially encloses a portion of said coaxial cable receptacle, a length of said flat strip link and said sleeve.

10. The connector as defined in claim 9, wherein said cover includes a tab projecting inwardly from an inside surface of a all of said cover and said sleeve includes a slot sized to receive said tab to permit said cover to be securely mounted to said sleeve in a snap-fit arrangement.

11. The connector as defined in claim 9, further including an adhesive pad that permits said connector to be mounted to an installation site.

12. The connector as defined in claim 11, wherein said adhesive pad including a double-sided adhesive pad.

13. The connector as defined in claim 9, wherein said sleeve includes a first side grip rail that retains said flat strip link.

14. The connector as defined in claim 13, wherein said sleeve comprises a second side grip rail that retains said flat strip link.

15. A junction assembly for electrically connecting together first and second flat strip transmission line links, each of the first and second transmission line links having at least one electrically conductive signal portion running a length thereof and at least one electrically conductive ground portion running a length thereof, each of said first and second transmission line links having flat end portions, said at least one electrically conductive ground and signal portions of both said first and second transmission line links terminating proximate the respective end portions thereof, the junction assembly comprising:

a protective cover for enclosing and protecting said first and second transmission line link end portions;

an electrically conductive sleeve for providing an electrical connection between said at least one ground portions of said first and second transmission line links, the conductive sleeve having means for engaging said protective cover, said conductive sleeve having first and second end portions that respectively receive said end portions of said first and second transmission line links; and, an electrically conductive contact member associated with said protective cover, the contact being held by said protective cover in opposition to said at least one signal contact portions of said first and second transmission line links, whereby when said first and second transmission line links are inserted into said conductive sleeve and said protective cover is engaged with said conductive sleeve, an electrical connection is established between said first and second transmission line link signal contact portions.

16. The assembly as defined in claim 15, wherein said protective cover includes at least one tab projecting therefrom and said conductive sleeve includes a slot sized to receive said tab to permit said protective cover to be securely mounted to said conductive sleeve in a snap-fit arrangement.

17. The assembly as defined in claim 15, wherein said contact member includes a flexible contact member having two free ends that extend into contact with said at least one signal contact portions of said first and second transmission line links.

18. The assembly as defined in claim 15, further including layer of adhesive disposed on a mounting surface of said conductive sleeve for mounting said assembly to a surface.

19. The assembly as defined in claim 18, wherein said adhesive layer includes a double-sided adhesive pad disposed on a bottom surface of said conductive sleeve.

20. The assembly as defined in claim 15, wherein said conductive sleeve includes pairs of first and second gripping rails that grip and retain in place with said conductive sleeve, said end portions of said first and second transmission line links.

21. The assembly as defined in claim 15, wherein said junction assembly includes an elbow junction assembly.

* * * * *